US008851035B2

(12) United States Patent
Gunnel

(10) Patent No.: US 8,851,035 B2
(45) Date of Patent: Oct. 7, 2014

(54) ACTUATOR UNIT FOR SLIDING CAM SYSTEMS WITH ACTUATOR PINS CONTROLLED BY CONTROL NEEDLES

(71) Applicant: Ronny Gunnel, Puschendorf (DE)

(72) Inventor: Ronny Gunnel, Puschendorf (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 74 days.

(21) Appl. No.: 13/621,306

(22) Filed: Sep. 17, 2012

(65) Prior Publication Data

US 2013/0087113 A1 Apr. 11, 2013

(30) Foreign Application Priority Data

Oct. 5, 2011 (DE) ..... 10 2011 084 039

(51) Int. Cl.
*F01L 1/34* (2006.01)
*H01H 9/00* (2006.01)
*F01L 13/00* (2006.01)

(52) U.S. Cl.
CPC ..... *F01L 13/0036* (2013.01)
USPC ..... 123/90.18; 335/179

(58) Field of Classification Search
USPC ..... 123/90.18; 335/229–235
See application file for complete search history.

(56) References Cited

U.S. PATENT DOCUMENTS

| | | | | |
|---|---|---|---|---|
| 6,425,359 | B2 * | 7/2002 | Fujii et al. | 123/90.18 |
| 6,967,550 | B2 * | 11/2005 | Elendt et al. | 335/229 |
| 2011/0240892 | A1 * | 10/2011 | Nendel | 251/129.01 |
| 2013/0000581 | A1 * | 1/2013 | Popp et al. | 123/90.18 |
| 2013/0241680 | A1 * | 9/2013 | Hanchett et al. | 335/234 |

FOREIGN PATENT DOCUMENTS

| | | |
|---|---|---|
| WO | 2010097298 | 9/2010 |
| WO | WO 2010097298 A1 * | 9/2010 |

* cited by examiner

*Primary Examiner* — Thomas Denion
*Assistant Examiner* — Steven D Shipe
(74) *Attorney, Agent, or Firm* — Volpe and Koenig, P.C.

(57) ABSTRACT

Reciprocating-piston internal combustion engine with intake and exhaust valves actuatable by sliding cams of a camshaft, arranged so that they are rotationally locked but axially moveable on a base shaft, and with an actuator unit for each sliding cam unit with at least one actuator pin for the displacement of the sliding cam units into different axial positions. The actuator pins are spring-loaded in the direction of the sliding cam unit and are fixable in their retracted position away from the sliding cam unit by latches having spring-loaded control needles that correspond to clamping bodies of the latches and are releasable via an electromagnet and permanent magnets that are in active connection with the control needles, and acceleration of the control needles defined by the spring force of each moving mass due to their springs is compensated by the acceleration of the actuator pins due to their allocated compressive springs.

8 Claims, 4 Drawing Sheets

ACTUATOR UNIT FOR SLIDING CAM SYSTEMS WITH ACTUATOR PINS CONTROLLED BY CONTROL NEEDLES

CROSS-REFERENCE TO RELATED APPLICATIONS

This application claims the benefit of German Patent Application No. 102011084039.7, filed Oct. 5, 2011, which is incorporated herein by reference as if fully set forth.

FIELD OF THE INVENTION

Reciprocating-piston internal combustion engine with at least one cylinder head with intake and exhaust channels that are each controlled by at least one gas-exchange valve constructed as intake and exhaust valves that can be actuated by cams of at least one camshaft and transmission elements driven by these cams, wherein the cams are constructed as sliding cams with at least one cam for each sliding cam unit and are arranged so that they are rotationally locked but can move in the axial direction on a base shaft that is controlled and driven fixed on the internal combustion engine, and with at least one actuator unit that is fixed on the internal combustion engine for each sliding cam unit with at least one actuator pin for the displacement of the sliding cam units into different axial positions via at least two displacement grooves that interact with the actuator pins on the periphery of the sliding cam units that have a screw-shaped construction and are arranged symmetrically opposite to each other and have at least one ejection ramp for the actuator pins, wherein the actuator pins are spring-loaded in the direction of the sliding cam unit and can be fixed in their retracted position facing away from the sliding cam unit by latch devices that can be locked and wherein the latches have spring-loaded control needles that correspond to clamping bodies of the latch devices and can be released by an electromagnet unit and permanent magnets that are in active connection with the control needles.

BACKGROUND

Such an actuator unit for reciprocating piston internal combustion engines is known from WO 2010/097298 A1. The permanent magnets in active connection with the electromagnetic unit are attached to the inner ends of the control needles. Springs that apply a load on the control needles and also the permanent magnets in the direction of the clamping bodies and clamp these clamping bodies together for fixing the actuator pins in their inner position contact the control needles, while the electromagnetic unit draws the permanent magnets and thus the control needles against the force of the springs and thus releases the clamping bodies.

It has been shown that the actuator pins are not quickly locked in place due to the ejection ramp when pushed in or become unlocked in the latch device, e.g., due to vibrations of the reciprocating piston internal combustion engine, and contact the displacement grooves or the peripheral area adjacent to the displacement grooves in an undesired way. The undesired release of the latched state can also occur if the actuator pin travels over edges on the peak circle of the displacement cam unit. If the actuator pin slips in the direction of the cam contours of the sliding cam unit, then it will be set back when traveling over the ejection ramp, i.e., the lowered actuator pin is pushed back to the level of the peak circle of the sliding cam unit. In this case, the control needle should ensure the locking of the latch device again immediately after pushing the actuator pin up, which is only the case if the acceleration caused by the spring force of the control needle is high enough to create the locked state quickly enough, which is not, however, always the case.

In order to be able to eject the actuator pin quickly enough even at low temperatures and poor viscosity of the engine oil, the spring on the actuator pin must have a sufficiently strong construction. This has the result that the acceleration caused by the spring on the actuator pins, especially for warm reciprocating piston internal combustion engines, is high enough that an incorrect latching by the control needles is amplified.

SUMMARY

The object of the invention is to improve an actuator unit for reciprocating piston internal combustion engines so that the disadvantages described above are avoided. It should be guaranteed that the control needles always react quickly enough also in the limiting regions and create the latching quickly enough, in order to clamp the actuator pins. This is to be realized with simple and cost-effective means.

This objective is met in that the acceleration of the control needles defined by the spring force of each moving mass due to their springs is essentially compensated by the acceleration of the actuator pins due to the spring force allocated to these pins.

Therefore it is guaranteed that the control needles can react as quickly as the actuator pins are accelerated by their springs so that even for the problems described in the prior art, a locking of the latch devices of the actuator pins can always be realized sufficiently quickly.

This could be realized, on one hand, by significantly increasing the spring force of the springs allocated to the control needles. This is not easy to achieve, however, because the coil of the electromagnetic unit must always work against the force of the springs of the control needles during the unlocking process and thus a larger coil with increased power consumption and breaking energy would have to be used. This would lead to undesirably large coils, however.

In another construction of the invention, it is proposed to reduce the moving mass of the control needles for the purpose of compensating for the acceleration accordingly.

Therefore, in another construction of the invention, it is provided to reduce the mass by decoupling the permanent magnets from the control needle. In this way, the mass of the control needle unit to be moved by the spring becomes considerably less, so that the acceleration can be significantly increased. The spring now needs to accelerate only the actual control needle without the mass of the permanent magnet in the direction of the latching device, so that a considerably quicker latching is realized that satisfies all of the operating conditions.

Advantageously, the control needles have a shaft on which the permanent magnet is arranged with radial and axial play on their end regions facing the permanent magnet.

At the end of the shaft there is a spring plate that forms a stop for the permanent magnet, so that this plate, moved by the electromagnetic unit, can release the control needle from the latched state. The spring plate is further used as a support for the respective spring of the control needle that is supported on a component adjacent to the electromagnetic unit.

The spring plate can be swaged with the end of the shaft of the control needle. It is also possible, however, that the spring plate has a shaft in which a channel is formed that extends inwards and corresponds to a groove on the shaft of the control needle, so that the spring plate can be pushed with the flange past the end of the shaft and engages there in the groove.

For improving the magnetic flux, a steel disk can be arranged on the shaft of the control needle with radial and axial play in addition to the control magnet. This disk is installed between the permanent magnet and a projection on the end of the shaft of the control needle.

It should be explicitly noted that the principle of decoupling a mass for moving switching elements can also be transferred to other switching valves and an increase in the ability to react can be achieved by the targeted change in total mass, for example, for quickly switching solenoid valves for controlling gas-exchange valves.

BRIEF DESCRIPTION OF THE DRAWINGS

The drawings that show an exemplary embodiment of the invention in a simplified manner will be referenced for the further explanation of the invention.

Shown are.

DETAILED DESCRIPTION OF THE PREFERRED EMBODIMENTS

Figure 4:
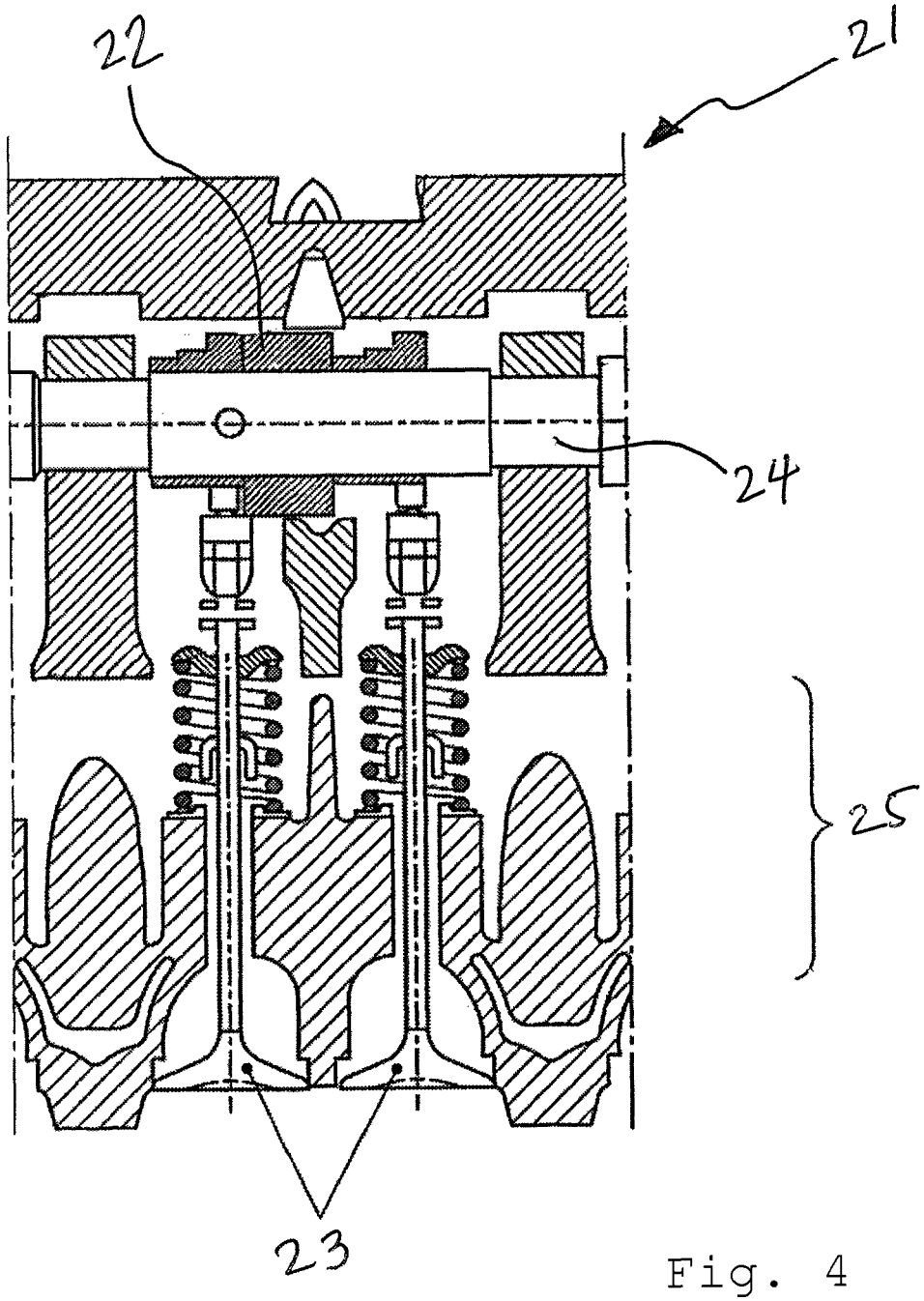
Fig. 4 (prior art)
FIG. 4 shows an engine including includes a sliding cam unit, valves, a camshaft, and a cylinder head according to the prior art.

FIG. 4 shows an engine 21 according to the prior art and includes a sliding cam unit 22, valves 23, a camshaft 24, and a cylinder head 25 according to the prior art.

Figure 1:
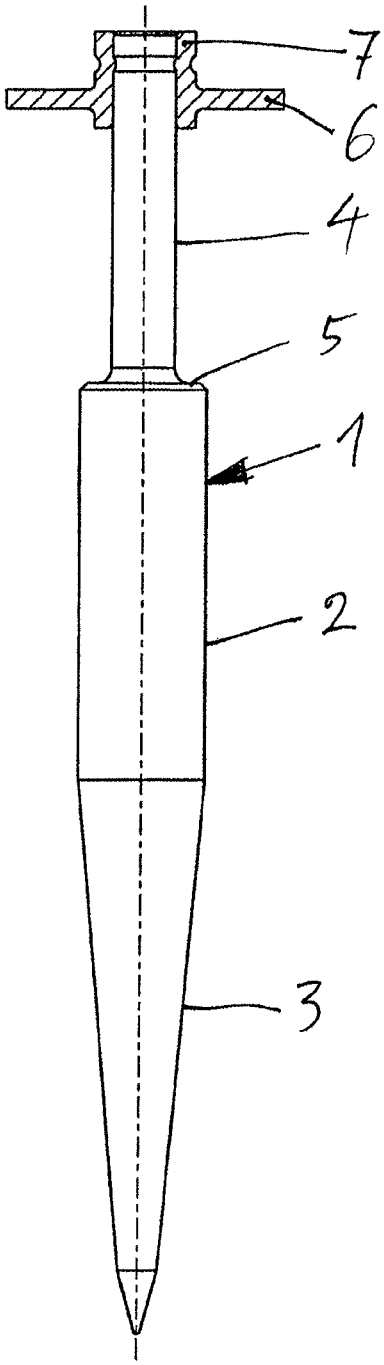
FIG. 1: a view of a control needle with spring plate mounted on its shaft.
Figure 2:
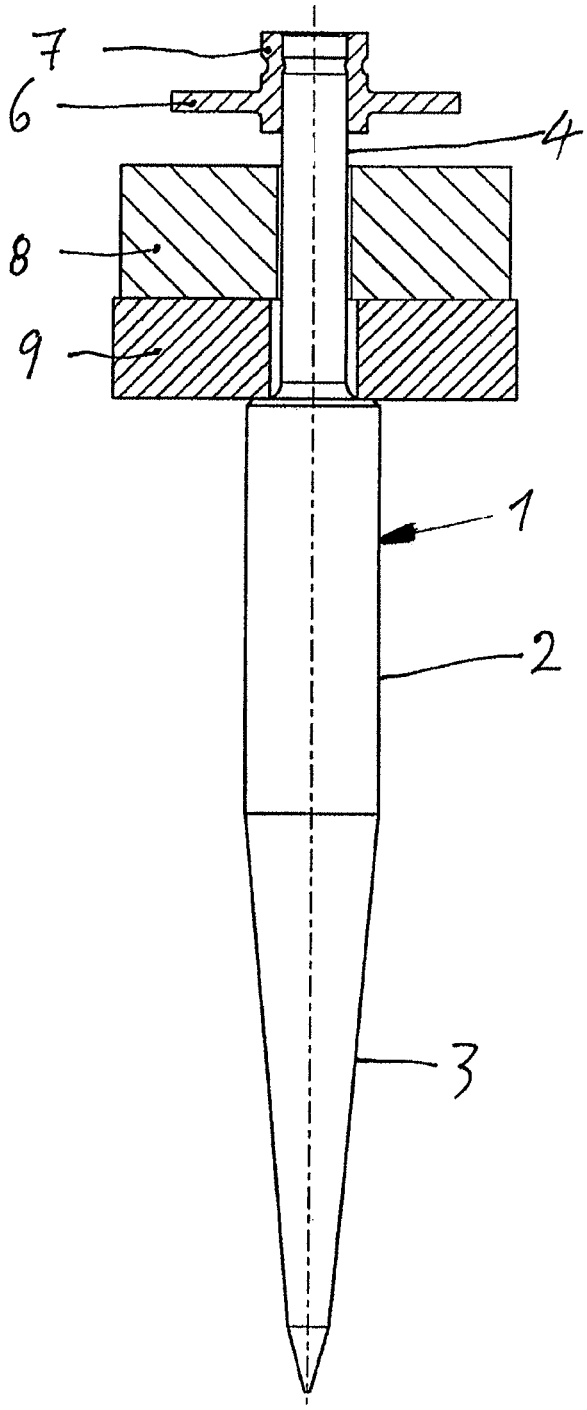
FIG. 2: a view of a control needle according to FIG. 1 in which a permanent magnet and a steel disk are arranged on the shaft.
Figure 3:
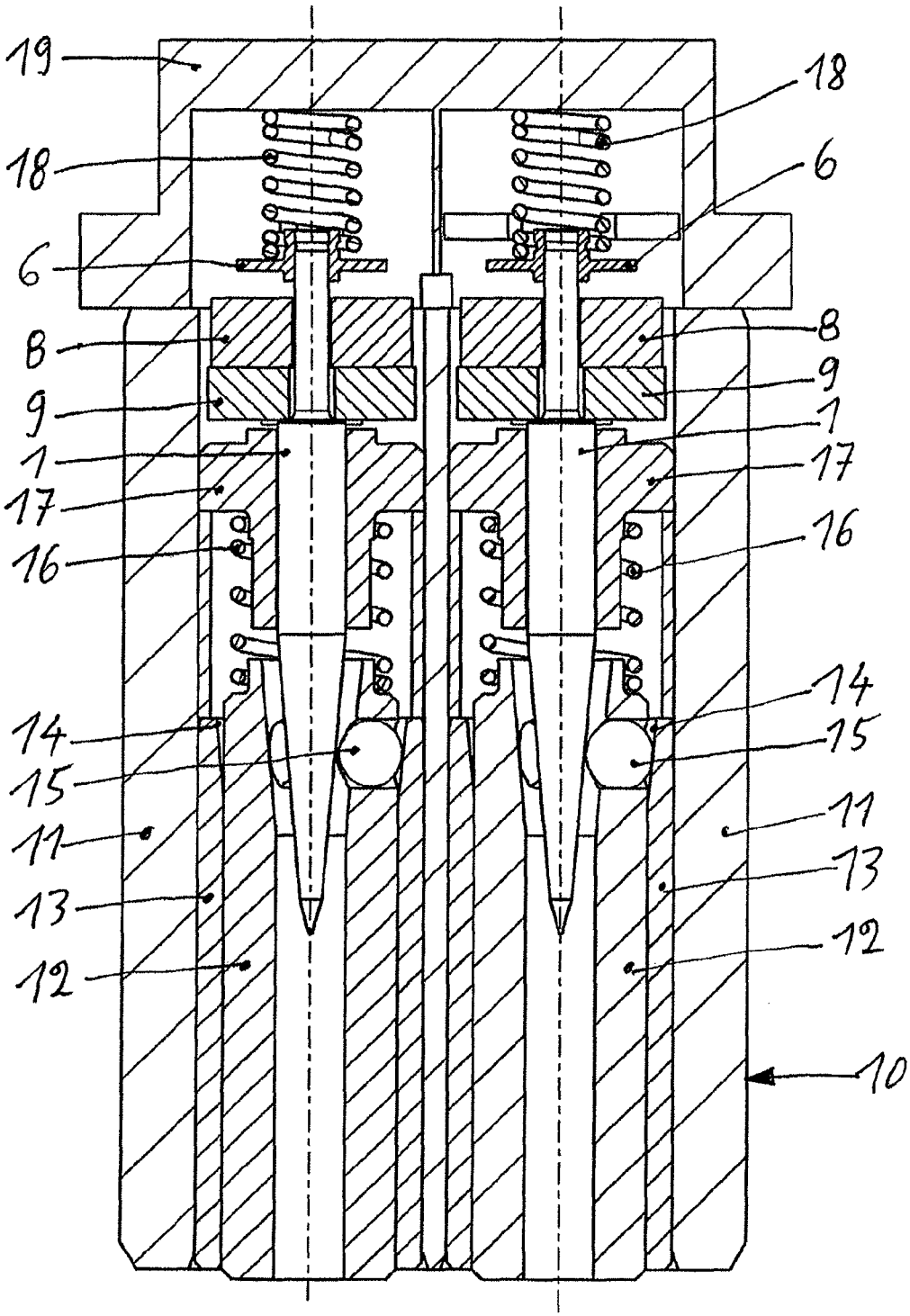
FIG. 3: a cross sectional view through an actuator unit with two actuator pins and two allocated control needles.

In FIGS. 1 to 3, as shown in detail, a control needle is designated with 1 and this needle has a cylindrical bearing area 2, a control tip 3, and a shaft 4. The shaft 4 has a reduced diameter that connects to the bearing area 2 via a projection 5. A spring plate that is designated with 6 is attached to the free end of the shaft 4. This spring plate has a flange 7 that is latched and therefore fixed by a channel in a groove of the shaft 4 of the control needle 1.

As can be seen in FIG. 2, a permanent magnet 8 and a steel disk 9 are arranged on the shaft 4 and this magnet and disk fill up the axial space of the shaft only partially between the plate spring 6 and projection 5 and are further arranged with radial play on the shaft 4, so that a complete decoupling of the permanent magnet 8 constructed as a disk and the steel disk 9 relative to the control needle 1 is given.

The control needle 1 with the spring plate 6, the permanent magnet 8, and the steel disk 9 are, as shown in FIG. 3, components of an actuator unit designated with 10. The actuator unit 10 has a sleeve 11 in which actuator pins 12 are guided so that they can be displaced with intermediate switching of sliding sleeves 13. On their inner ends, the sliding sleeves 13 have conical extensions 14 that are in active connection with clamping bodies 15 constructed as balls. The clamping bodies 15 are installed in openings of the actuator pins 12 and are controlled by the control tips 3 of the control needles 1. The actuator pins 12 are loaded in the ejection direction by compressive springs 16, wherein the compressive springs 16 are supported on guide elements 17 that are fixed on the sleeve 11. The guide elements 17 have bearings in which the bearing area 2 of the control needles 1 is fixed in the radial direction but is guided so that it can move in the axial direction. The spring plate 6 of the control needles 1 is in active connection with a spring 18 that is constructed as a compressive spring and is further supported on a component 19 that is connected, not shown, to the electromagnetic unit, so that the component 19 advantageously does not have a magnetic construction.

For releasing the clamping bodies 15 and thus unlocking the actuator pins 12, the not-shown electromagnetic unit is not energized, so that this attracts the permanent magnet 8 and the steel disks 9 and thus lifts the control needles 1 with the spring plate 6 against the force of the spring 18. Through the decoupling of the permanent magnet 8 and the steel disks 9 according to the invention, the unlocking of the control needles 1 also takes place more quickly, because the electromagnetic unit must initially move only the permanent magnet 8 and the steel disks 9 that then displace the control needles 1 in an already accelerated, quicker, and more secure way and can compress the springs 18. If the actuator pins 12 have pushed outward from their inner position, e.g., due to vibrations of the reciprocating piston internal combustion engine, and are pushed back, e.g., due to an ejection ramp of the displacement groove, a short or a longer distance in the normal operation, then the control needles 1 are able at any time, because they are loaded by the springs 18, to latch the clamping bodies 15 within a very short time, because the springs 18 must accelerate only the spring plate 6 and the control needle 1.

LIST OF REFERENCE NUMBERS

1 Control needle
2 Bearing area
3 Control tips
4 Shaft
5 Projection
6 Spring plate
7 Flange
8 Permanent magnet
9 Steel disk
10 Actuator unit
11 Sleeve
12 Actuator pins
13 Slide sleeves
14 Conical extensions
15 Clamping bodies
16 Compressive springs
17 Guide elements
18 Springs
19 Components

The invention claimed is:

1. A reciprocating-piston internal combustion engine comprising at least one cylinder head with intake and exhaust channels that are each controlled by at least one gas-exchange valve constructed as intake and exhaust valves that can be actuated by cams of at least one camshaft and transmission elements driven by these cams, wherein the cams are each constructed as sliding cam units with at least one cam are arranged so that they are rotationally locked but can move in an axial direction on a base shaft that is controlled and driven fixed on the internal combustion engine, and at least one actuator unit that is fixed on the internal combustion engine for each of the sliding cam units, at least one actuator pin for displacement of the sliding cam units into different axial positions via at least two displacement grooves that interact with the actuator pins on a periphery of the sliding cam units that have a screw-shaped construction and are arranged symmetrically opposite to each other and each have at least one ejection ramp for the actuator pins, the actuator pins are spring-loaded in a direction of at least one of the sliding cam units and are fixable in a retracted position away from the sliding cam unit by latch devices that are lockable and the latch devices have spring-loaded control needles that correspond to clamping bodies of the latch devices and the latch devices are releasable via an electromagnet unit and permanent magnets that are in active connection with the control needles, wherein the permanent magnets are decoupled from the control needles, and acceleration of the control needles defined by a spring force of a moving mass of each of the control needles due to springs is essentially compensated by acceleration of the actuator pins due to compressive springs allocated thereto.

2. A reciprocating-piston internal combustion engine according to claim 1, wherein the moving mass of each of the control needles is reduced accordingly for equalizing the acceleration of the actuator pins due to the compressive springs.

3. The reciprocating-piston internal combustion engine according to claim 1, wherein each of the control needles has, on an end area facing the permanent magnet, a shaft on which the permanent magnet is arranged with radial play.

4. The reciprocating-piston internal combustion engine according to claim 3, wherein a spring plate that connects to the spring of each of the control needles is fastened on an end of the shaft.

5. The reciprocating-piston internal combustion engine according to claim 4, wherein the spring plate is swaged with the end of the shaft.

6. The reciprocating-piston internal combustion engine according to claim 4, wherein a channel that contacts a groove on the shaft of each of the control needles is machined into the spring plate.

7. The reciprocating-piston internal combustion engine according to claim 4, wherein the permanent magnet has an axial play between the spring plate and a projection of each of the control needles.

8. The reciprocating-piston internal combustion engine according to claim 3, wherein, in addition to the permanent magnet, a steel disk with radial and axial play is arranged on the shaft of each of the control needles.

* * * * *